United States Patent [19]

Hasegawa

[11] Patent Number: 4,934,455

[45] **Date of Patent: * Jun. 19, 1990**

[54] PLATE-FIN HEAT EXCHANGER

[75] Inventor: Kaoru Hasegawa, Sakai, Japan

[73] Assignee: Showa Aluminum Corporation, Osaka, Japan

[ * ] Notice: The portion of the term of this patent subsequent to Feb. 14, 2006 has been disclaimed.

[21] Appl. No.: 199,736

[22] Filed: May 27, 1988

[30] Foreign Application Priority Data

May 29, 1987 [JP] Japan ..... 62-84881[U]

[51] Int. Cl.[5] ..... F28F 3/00

[52] U.S. Cl. ..... 165/166; 165/170

[58] Field of Search ..... 165/166, 170

[56] References Cited

U.S. PATENT DOCUMENTS

| | | | |
|---|---|---|---|
| 3,432,357 | 3/1969 | Dankese | 165/166 |
| 3,528,496 | 9/1970 | Kun | 165/166 |
| 3,568,462 | 3/1971 | Hoffman et al. | 165/166 |
| 3,650,005 | 3/1972 | Kamiya et al. | 165/170 |
| 4,025,462 | 5/1977 | Cleveland | 165/166 |
| 4,116,271 | 9/1978 | De Lepeleire | 165/166 |
| 4,434,845 | 3/1984 | Steeb | 165/166 |
| 4,460,388 | 7/1984 | Fukami et al. | 165/166 |
| 4,729,428 | 3/1988 | Yasutake et al. | 165/166 |
| 4,804,041 | 2/1989 | Hasegawa et al. | 165/166 |

*Primary Examiner*—Henry A. Bennet
*Assistant Examiner*—Denise L. Ferensic
*Attorney, Agent, or Firm*—Armstrong, Nikaido, Marmelstein, Kubovcik & Murray

[57] ABSTRACT

A plate-fin heat exchanger having two fluid channels. The first fluid channel is defined by two flat plates opposed to each other at a specified spacing, and a first channel forming member interposed between the flat plates. The channel forming member is in the form of an aluminum extrudate comprising a pair of right and left spacing side walls and a hollow connecting wall interconnecting the side walls and wavelike in the cross section of at least one of its upper and lower surfaces. The second fluid channel is defined by two flat plates opposed to each other at a specified spacing, a pair of spacing side wall portions provided therebetween and a fin member positioned between the side wall portions.

6 Claims, 2 Drawing Sheets

PLATE-FIN HEAT EXCHANGER

BACKGROUND OF THE INVENTION

The present invention relates to plate-fin heat exchangers, for example, for use in aftercoolers, radiators and gas coolers.

The term "aluminum" as used herein includes pure aluminum and aluminum alloys.

Generally with heat exchangers for use in aftercoolers, radiators and the like, improved performance can be achieved more effectively by providing an increased heat transfer area than by disturbing the flow of the fluid, especially remarkable in the case of air, in view of the characteristics of the fluid.

Such heat exchangers heretofore known have at least one first fluid channel for passing a first fluid therethrough and at least one second fluid channel for passing therethrough the second fluid to be subjected to heat exchange with the first fluid. The first channel is defined by two flat plates opposed to each other at a specified spacing, and a first channel forming member provided between these plates. The channel forming member is made of an aluminum extrudate which comprises a pair of opposed spacing side walls, and a connecting wall resembling comb teeth in cross section and interconnecting the side walls. Since the channel forming member comprises the comb-toothed connecting wall having thin fins, the member is not extrudable satisfactorily, is extremely difficult to make and is likely to involve dimensional variations. The ends of the fins are liable to become rounded when extruded and therefore contact the flat plate over a reduced area and be prone to forming a faulty joint. The channel forming member has relatively low strength, so that the platelike base portion is liable to fracture or the fin is liable to bend during handling. The member is therefore difficult to handle. Consequently, the heat exchanger is not easy to fabricate, has a relatively small heat transfer area and is low in heat exchange efficiency.

SUMMARY OF THE INVENTION

The main object of the present invention is to provide a plate-fin heat exchanger which is free of the above problems.

The invention provides a plate-fin heat exchanger having at least three flat plates spaced apart and arranged parallel to one another and a first fluid channel and a second fluid channel formed between the respective two adjacent flat plates. The exchanger is characterized in that the first fluid channel is defined by the two flat plates opposed to each other at a specified spacing and a first channel forming member interposed between the flat plates, the first channel forming member being in the form of an aluminum extrudate comprising a pair of spacing side walls arranged in corresponding relation to the respective right and left side edges of the flat plates and a hollow connecting wall interconnecting the side walls and internally having a multiplicity of hollow portions in parallel to the side walls, at least one of the upper and lower surfaces of the connecting wall having a wavelike cross section, the connecting wall having ridges joined at their top faces to the flat plate opposed thereto; the second fluid channel being defined by the corresponding two flat plates opposed to each other at a specified spacing, a pair of spacing side wall portions provided between the flat plates and arranged in corresponding relation to the respective right and left, or front and rear side edges of the flat plates, and a fin member positioned between the side wall portions.

The first channel forming member of the exchanger of the invention has a multiplicity of hollow portions, is wavelike in the cross section of at least one of its upper and lower surfaces, is extrudable satisfactorily, has strength against deformation such as twisting, distortion or bending, is easy to handle and therefore assures facilitated fabrication of the exchanger. The member can be bonded to the flat plate satisfactorily, gives increased resistance to pressure and has a large heat transfer area to achieve outstanding heat exchange performance.

The invention will be described in greater detail with reference to the accompanying drawings.

DESCRIPTION OF THE PREFERRED EMBODIMENTS

Figure 2:
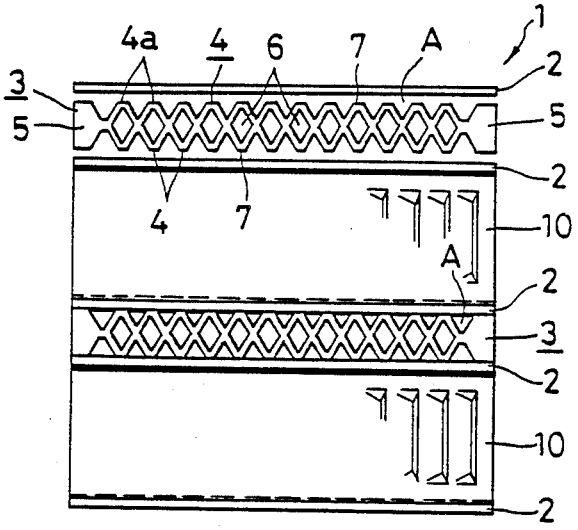
FIG. 2 is a partly exploded front view of the embodiment of FIG. 1.

The terms "front," "rear," "right" and "left" are used herein based on FIG. 2; "front" refers to the front side of the plane of FIG. 2, "rear" to the rear side thereof, "right" to the right-hand side of FIG. 2, and "left" to the left-hand side thereof.

Figure 1:
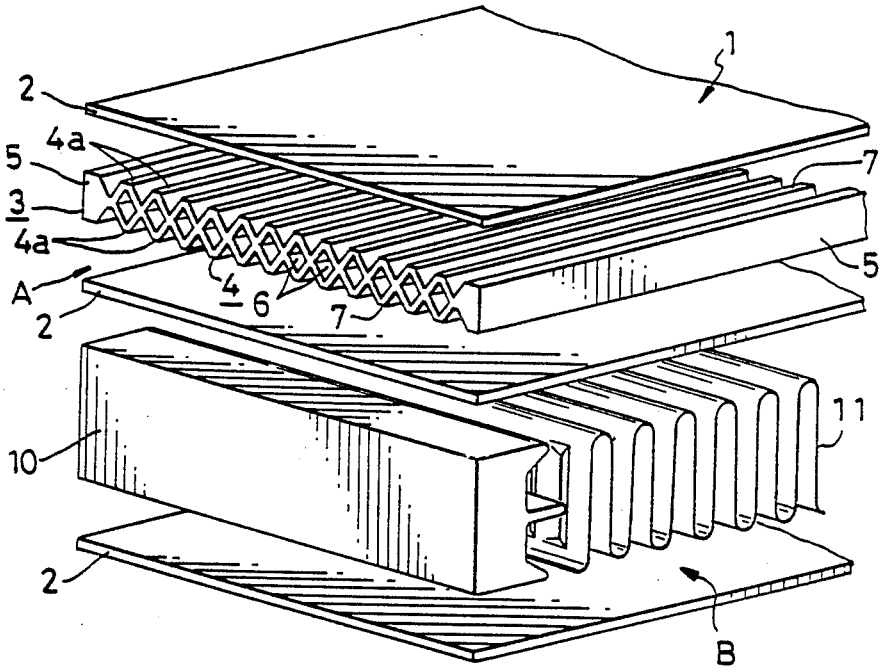
FIG. 1 is a fragmentary perspective view showing an embodiment of the invention.

With reference to FIGS. 1 and 2 showing an embodiment of the invention, i.e. a heat exchanger 1, the exchanger 1 has at least one first fluid channel A for passing a first fluid therethrough, and at least one second fluid channel B for passing therethrough the second fluid to be heat-exchanged with the first fluid.

The first fluid channel A is defined by two flat plates 2, 2 each comprising an aluminum brazing sheet and opposed to each other at a specified spacing and a first channel forming member 3 interposed between the flat plates 2, 2. The first channel forming member 3 is made of an aluminum extrudate comprising a pair of spacing side walls 5, 5 arranged in corresponding relation to the respective right and left side edges of the flat plates 2 and a hollow connecting wall 4 interconnecting the side walls 5, 5 and internally having a multiplicity fluid flow passages or of hollow portions 6 in parallel to the side walls 5, 5. Each of the upper and lower surfaces of the connecting wall 4 has a wavelike cross section. Thus, the connecting wall 4 is provided on its opposite sides with ridges 4*a* each having a flat top face 7 and joined to the respective flat plates 2 at their flat top faces 7.

The second fluid channel B is defined by two flat plates 2, 2 each comprising an aluminum brazing sheet and opposed to each other at a specified spacing, a pair of spacing side walls 10, 10 each made of an aluminum extrudate, provided between the flat plates 2, 2 and arranged in corresponding relation to the respective front and rear side edges of the flat plates 2, 2, and a louvered corrugated fin 11 made of aluminum plate and positioned between the side walls 10, 10.

The heat exchanger, 1 is, fabricated by placing the above described components, in a vertical stacked array as shown by FIGS. 1 and 2. That is, at least three flat plates 2 each comprising an aluminum blazing sheet are provided the first channel forming member 3 made of aluminum extrudate is positioned between the upper two adjacent flat plates 2, 2, the two spacing side walls 10, 10 each made of aluminum extrudate are positioned between the lower two adjacent flat plates 2, 2 for defining the second fluid channel B, and the louvered corrugated fin 11 of aluminum plate is positioned between the side walls 10, 10. The assembled components are the joined into a unit by brazing, for example, by vacuum brazing.

The first channel forming member 3 described has the multiplicity of hollow portions 6 and is wavelike in the cross section of its upper and lower surfaces. The conventional channel forming member has a connecting wall resembling comb teeth in cross section and formed with vertical fins, whereas the two adjacent fins of the first channel forming member 3 of the invention are inclined toward each other and butted against each other at their forward ends to form a continuous wavelike surface portion. The channel forming member of the invention is therefore extrudable satisfactorily, has high strength against deformation such as twisting, distortion or bending, is easy to handle, has about 9% larger heat transfer area than the conventional one and consequently achieves higher heat exchange performance. Moreover, the top face 7 of each ridge 4*a* of the connecting wall 4 is about 50% larger in area than the corresponding portion of the conventional one, so that the wall 4 can be blazed to the flat plate 2 very effectively.

Figure 4:
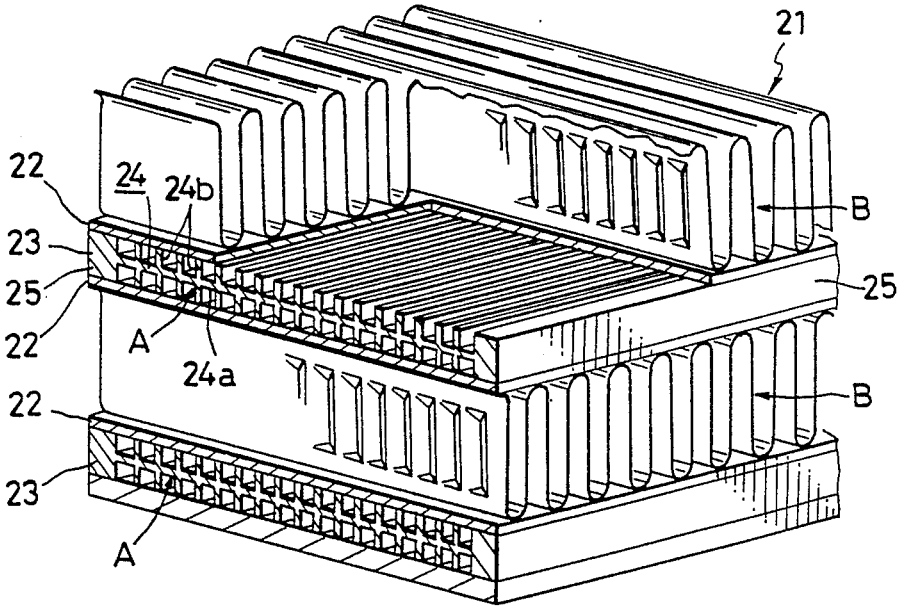
FIG. 4 PRIOR ART
FIG. 4 is a perspective view partly broken away and showing a conventional heat exchanger.

FIG. 4 shows a conventional heat exchanger 21 which has at least one first fluid channel A for passing a first fluid therethrough and at least one second fluid channel B for passing therethrough the second fluid to be heat-exchanged with the first fluid. The first channel A is defined by two flat plates 22, 22 opposed to each other at a specified spacing, and a first channel forming member 23 provided between these plates 22, 22. The channel forming member 23 is made of an aluminum extrudate which comprises a pair of opposed spacing side walls 25, 25, and a connecting wall 24 resembling comb teeth in cross section and interconnecting the side walls 25, 25.

Since the channel forming member 23 of the conventional exchanger comprises the comb-toothed connecting wall 24 having thin fins, the member is not extrudable satisfactorily, is extremely difficult to make and is likely to involve dimensional variations. The ends of the fins 24*b* are liable to become rounded when extruded and therefore contact the flat plate over a reduced area and be prone to form a faulty joint. The fins 24*b* are provided side by side on a flat platelike base portion 24*a*, so that the base portion 24*a* is likely to warp, distort or twist when extruded. Because the member has relatively low strength, the base portion 24*a* is liable to fracture or the fin 24*b* is liable to bend during handling, hence difficulty in handling. Consequently, the exchanger has the problem of being not easy to fabricate, having a relatively small heat transfer area and being low in heat exchange efficiency.

Figure 3:
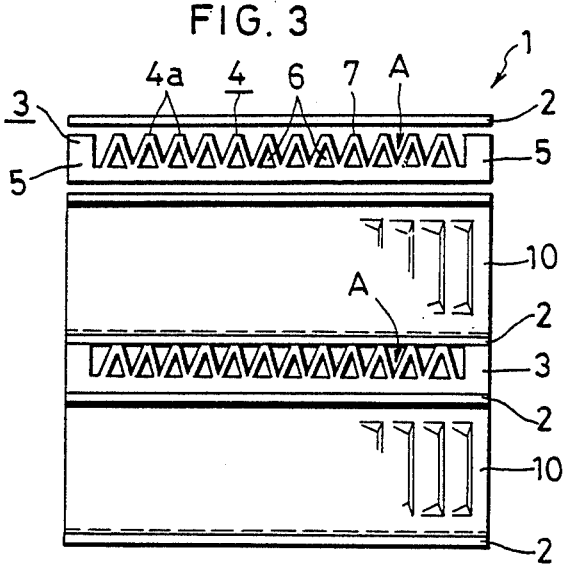
FIG. 3 is a partly exploded front view of another embodiment of the invention.

FIG. 3 shows another embodiment of the invention, which differs from the first embodiment of FIGS. 1 and 2 in that the first channel forming member 3 has an upper surface with a wavelike cross section and a flat lower surface. This embodiment has the same advantages as the first embodiment.

Since the second embodiment has the same construction as the first with the exception of the above feature, like parts are designated by like reference numbers or symbols throughout FIGS. 1 to 3.

According to the present invention, the heat exchanger 1 comprises at least three flat plates 2. Theoretically, therefore, the heat exchanger of the smallest size has one first fluid channel A and one second fluid channel B. For use in aftercoolers, radiators or gas coolers, for example, the heat exchanger 1 actually has 1 to 20 first fluid channels A and 1 to 20 second fluid channels B which are arranged alternately. Such numbers of channels A and B are given merely for illustrative purposes. The numbers of channels A and B are determined according to the size and performance of the exchanger 1 contemplated. The fin member 11 for the second channel B is not limited to a corrugated fin but can of course be a fin which is shaped otherwise.

Although the foregoing embodiments are used as horizontal heat exchangers wherein the first and second fluid channels A and B are arranged horizontally, these heat exchangers may be used as vertical exchangers wherein the channels A and B are vertical. The heat exchanger 1 is not only usable for aftercoolers, radiators and gas coolers but is also usable as any heat exchanger wherein two kinds of fluids, i.e. gases or liquids, are heat-exchanged.

Although the first fluid channel A and the second fluid channel B of the illustrated exchangers 1 are arranged at right angles with each other, the two channels A and B may be arranged in parallel. In this case, two fluids are passed through the respective channels A and B in a concurrent or countercurrent relation to each other.

What is claimed is:

1. A plate-fin heat exchanger having a first fluid channel and a second fluid channel formed by at least three flat plates arranged parallel to one another at a predetermined spacing and opposed sidewalls provided between opposed surfaces of adjacent ones of said flat plates comprising:

a first fluid channel defined by a first pair of opposed surfaces of said flat plates and a first channel forming member interposed between said first pair of opposed surfaces of said flat plates, said first channel forming member comprising an aluminum extrusion having a pair of sidewalls provided between and spacing opposite edges of said first pair of opposed surfaces of said flat plates and a hollow all connecting said sidewalls of said aluminum extrusion and having a plurality of internal hollow fluid flow passage extending parallel to said sidewalls, said hollow wall having an upper surface and a lower surface with at least one of said upper and lower surfaces of said connecting wall having a wave-like cross-section providing spaced ridges joined to the surface of the flat plate opposed thereto, a second fluid channel defined by a second pair of opposed surfaces of said flat plates and a second pair of sidewalls provided between and spacing opposite edges of said second pair of opposed surfaces of said flat plates, and a fin member positioned between said second pair of sidewalls.

2. A heat exchanger as defined by claim 1 wherein the upper surface and the lower surface of the hollow wall of the first channel forming member each have a wavelike cross-section.

3. A heat exchanger as defined by claim 1 wherein only one of the upper and lower surfaces of the hollow wall of the first channel forming member is wavelike in cross-section.

4. A heat exchanger as defined in claim 2 or 3 wherein the ridges of the surface of the hollow wall having the wavelike cross-section each have a flat surface opposing one of said first pair of opposed surfaces of said flat plates.

5. A heat exchanger as defined by claim 1 which comprises a plurality of first fluid channels and second fluid channels and said plurality of first and second fluid channels are arranged alternately.

6. A heat exchanger as defined by claim 1 wherein each of said flat plates comprises an aluminum brazing sheet, each of said second pair of sidewalls provided between and spacing said opposite edges of said second pair of opposed surfaces of said flat plate are comprised an aluminum extrusion, the fin member between said second pair of sidewalls is made of aluminum and said flat plates, said first channel forming member, said second pair of sidewalls an said fin member are joined together by brazing.

* * * * *